US011052453B2

(12) United States Patent
Liu et al.

(10) Patent No.: US 11,052,453 B2
(45) Date of Patent: Jul. 6, 2021

(54) RIVETING TOOL CHUCK AND RIVETING TOOL

(71) Applicant: Hangzhou Lianwei Technology Co., Ltd., Zhejiang (CN)

(72) Inventors: Fengli Liu, Zhejiang (CN); Fuhua Qiu, Zhejiang (CN); Xiangteng Yao, Zhejiang (CN); Lingyun Yang, Zhejiang (CN); Yong Guo, Zhejiang (CN); Dayun He, Zhejiang (CN); Jun Gao, Zhejiang (CN); Wenhong Ren, Zhejiang (CN)

(73) Assignee: Hangzhou Lianwei Technology Co., Ltd., Zhejiang (CN)

( * ) Notice: Subject to any disclaimer, the term of this patent is extended or adjusted under 35 U.S.C. 154(b) by 85 days.

(21) Appl. No.: 16/490,813

(22) PCT Filed: Feb. 24, 2018

(86) PCT No.: PCT/CN2018/077116
§ 371 (c)(1),
(2) Date: Sep. 3, 2019

(87) PCT Pub. No.: WO2018/157763
PCT Pub. Date: Sep. 7, 2018

(65) Prior Publication Data

US 2019/0388958 A1 Dec. 26, 2019

(30) Foreign Application Priority Data

Mar. 2, 2017 (CN) ..... 201710120231.X

(51) Int. Cl.
*B21J 15/26* (2006.01)
*B21J 15/28* (2006.01)
(Continued)

(52) U.S. Cl.
CPC ..... *B21J 15/26* (2013.01); *B21J 15/28* (2013.01)

(58) Field of Classification Search
CPC . B21J 15/26; B21J 15/28; B21J 15/383; B21J 15/105; B21J 15/043; B21J 15/00
See application file for complete search history.

(56) References Cited

U.S. PATENT DOCUMENTS 6,018,978 A * 2/2000 Aniento ..... B21J 15/043 29/243.526
8,307,690 B2 * 11/2012 Cobzaru ..... B21J 15/285 72/453.17
(Continued)

FOREIGN PATENT DOCUMENTS

CN 2115847 9/1992
CN 2115847 U * 9/1992
(Continued)

OTHER PUBLICATIONS

First Chinese Office Action, issued in the corresponding Chinese patent application No. 201710120231.X, dated Jan. 2, 2018, 7 pages (English Translation provided).
(Continued)

*Primary Examiner* — Bayan Salone
(74) *Attorney, Agent, or Firm* — Hamre, Schumann, Mueller & Larson, P.C.

(57) ABSTRACT

A riveting tool chuck. The riveting tool chuck comprises a cylinder handgrip (1). A rotating member (2) and a transmission member (3) are disposed in the cylinder handgrip in a penetrating manner, the rotating member is axially positioned and circumferentially and rotatably connected to the cylinder handgrip, and the transmission member is circumferentially positioned and axially and movably connected to the cylinder handgrip, and the rotating member and the transmission member are connected by means of a thread
(Continued)

structure (4). A safety valve mechanism (9) that can enable the thread structure to have a screw pair pretightening force is disposed between claw body top columns (8) and the transmission member, and in the process of forward rotation of the rotating member, the safety valve mechanism can enable the rotating member to implement screw pair transformation of a screw structure before the axial reaction force between the front end of each claw body (5) and the rear end of a cylinder guiding nozzle (7) is reduced to zero, so that backlash stroke of the screw structure is avoided. A riveting tool using the riveting tool chuck. The riveting tool chuck has the advantages that the structural design is reasonable, and the riveting tool chuck can be adaptive to a driving device containing power output, can provide a pretightening force for screw pairs, and has no backlash stroke.

16 Claims, 5 Drawing Sheets

(51) Int. Cl.

| | |
|---|---|
| ***B21J 15/00*** | (2006.01) |
| ***B21J 15/38*** | (2006.01) |
| ***B21J 15/04*** | (2006.01) |
| ***B21J 15/10*** | (2006.01) |

(56) References Cited

U.S. PATENT DOCUMENTS

| | | | | |
|---|---|---|---|---|
| 8,893,363 | B2 * | 11/2014 | Taylor | F16B 19/1063 29/243.53 |
| 2011/0048099 | A1 * | 3/2011 | Cobzaru | B21J 15/043 72/453.17 |
| 2019/0388958 | A1 * | 12/2019 | Liu | B21J 15/28 |

FOREIGN PATENT DOCUMENTS

| | | | | |
|---|---|---|---|---|
| CN | 201287182 | | 8/2009 | |
| CN | 203804132 | | 9/2014 | |
| CN | 106734831 | | 5/2017 | |
| CN | 206588289 | | 10/2017 | |
| JP | 2005-059076 | | 3/2005 | |
| JP | 2005059076 | A * | 3/2005 | |
| JP | 3993844 | | 10/2007 | |
| JP | 3993844 | B2 * | 10/2007 | B21J 15/26 |
| WO | WO-2018157763 | A1 * | 9/2018 | B21J 15/105 |

OTHER PUBLICATIONS

International Search Report, issued in the corresponding PCT application No. PCT/CN2018/077116, dated May 25, 2018, 6 pages (English Translation provided).

* cited by examiner

RIVETING TOOL CHUCK AND RIVETING TOOL

TECHNICAL FIELD

The invention belongs to the technical field of machinery and relates to a riveting device, in particular to a riveting tool chuck and a riveting tool.

BACKGROUND TECHNIQUE

Riveting fasteners are widely used in aerospace, military, automotive, marine, construction, installation, manufacturing and other industries with requirements for riveting and fastening, and they are also widely used in civilian use, therefore the annual demand for various riveting tools is huge in relevant industries and domestic and foreign civilian markets. Riveting tools are developed to be more cost-effective, precise, convenient, efficient, and labor-saving. In order to improve the laboriousness, cumbersomeness and inefficiency of manual riveting tools, the integral pneumatic riveting tools have been developed and popularized. Pneumatic riveting tools are mainly used in the industrial market. Due to the limitation of compressed air source and high price, the market expansion of pneumatic riveting tools is hindered. With its portability and easier access to power source, the integral electric riveting tool has recently attracted wide market attention. However, there are not many products available in the domestic and foreign markets. Because the product has a high unit price due to its complex structure, it is mainly for industry market. In recent years, it has become widely used to turn riveting tools into rotating tool chucks adapted to general power output devices. Since the rotating tool device adapted thereto having power output thereto is common tools, such as drills, etc., the riveting tool chuck is a valuable, meaningful and market-oriented development direction, which has emerged as a new type of riveting tool product (see JP3993844 and US006018978).

One of the common mechanical features of a riveting tool chuck or riveting tool attachment driven by a manual, pneumatic, electric or drive tool is that the working load is transmitted to the riveting fastener to become an axial tensile force through force or torque exerted by a cord rod passing through the front end of the riveting tool chuck or riveting tool attachment. When the axial tensile load exceeds the yield limit of the riveting fastener, the thin-walled portion of the riveting fastener will be axially compressed and deformed, forming a junction with the fastened object. When the axial riveting load exceeds the tensile limit of the cord rod material, the cord rod is pulled off to complete the pulling operation. During the operation, the cord rod is fixed in the direction of the axial tensile riveting load. On the conventional pulling cord rivet rotating tool chuck (see JP3993844 and US006018978), the rotary driving tool applies axial tension and displacement to the core rod through the thread drive to complete the riveting. During the operation, an external force is required to clamp the outer casing to prevent it from rotating with the driving tool, otherwise the function is invalid.

During the thread drive, the forward screw pair and the reverse screw pair of the passive component are respectively located on both sides of the thread. When the driving direction of the active component is changed, the transmission mechanism needs to perform the screw pair switch before the passive component can be turned by the active component. Therefore, in general, when shifting between the forward gear and the reverse gear in the screw nut transmission mechanism, the screw pair conversioning is first performed. The riveting tool chuck (see JP3993844 and US0060189787) use a thread drive structure as torque and displacement transmission mechanism. The active mechanism of the thread transmission mechanism in JP3993844 is an axially fixed screw, and the active mechanism used in US0060189787 is a fixed screw nut. Although the active and passive components of the two patented thread transmission mechanisms have different configurations, the working principle is the same. It can be seen that the riveting tool chuck (see JP3993844 and US0060189787) comprises a threaded transmission mechanism and a complete working stroke during operation includes two actions in two directions comprising a retracting and pulling action and an action of advancing and exiting the rivet tail rod. When the rotation direction of the rotary driving tool is changed, the steering of the active component connected to the rotary driving tool will also be converted. Similarly, the shift between the rivet screw pair and the exiting screw pair on the driven component also needs to be performed first, then the driven component will move in a reverse linear manner under the action of the rotary driving tool. Since the load during the stroke of exiting rivet tail rod is small, no detailed analysis is discussed, and the pull-rivet stroke is mainly described herein.

At the end of the operation of exiting the rivet tail rod, the claw and the claw top column are retracted into the extreme position of the inner cavity of the inner tube, the claw is in a fully open state, the claw sleeve is at the extreme position of the forefront end, and the claw core forms a cylindrical space slightly larger than guiding nozzle to allow for exiting of the rivet tail rod or inserting a new lever rivet. The end point of exiting rivet tail rod stroke is also the starting point of the pull-rivet stroke. In this case, in US0060189787, the compressed amount of the front preloaded spring becomes large, and in JP3993844 the compressed amount of the preloaded spring becomes large, so that the claw front end face and the rear end face of the guiding nozzle are axially held in pressure contact, and the screw completely exits the threaded area of the transmission part internal thread and is in pressure contact with the part, and the front and rear pressures are in a static equilibrium state. After inserting the rivet, the screw starts to rotate under the driving tool, the screw enters the threaded area, and the pull-rivet stroke starts. At this time, the screw pair is still the exiting screw pair in the stroke of exiting the rivet tail rod. During the pull-rivet stroke of the riveting tool chuck, the screw driving mechanism first performs the screw pair conversion, and then the riveting load can be loaded for the riveting.

In the design of the thread transmission mechanism, the threaded area is discussed in detail. If the mechanism is involved in the re-entry problem after exiting the threaded area, a preloading aid is usually required. The pre-loading problem of thread re-entry is a common problem in the screw nut transmission mechanism and is also a necessary condition for the mechanism to continuously perform repeated work. Specifically, taking a close look at the existence of the pre-loading force of the transmission screw pair during the entire pull-rivet stroke, it can be found that JP3993844 addresses the pre-loading force problem in the early and late strokes of the thread transmission through a spring. Early stroke: from the beginning of the pull-rivet stroke till exiting the tail rod and releasing the screw pair, the front end surface of the claw remains zero pressure contact with the rear end surface of the guiding nozzle, and the front end of the spring is compressed to generate a preloading force. Late stroke: from the front end surface of the screw is in pressure contact with a cored spring stop piece until the end of the pull-rivet stroke, the spring is compressed from the rear end to form a preloading force. US0060189787 uses two springs to separately handle the pre-loading force of the early and late strokes of the thread transmission stroke at the front and rear working positions of the movable screw. Early stroke: from the beginning of the pull-rivet stroke till exiting the tail rod and releasing the screw pair, the front end surface of the claw remains zero pressure contact with the rear end surface of the guiding nozzle, and the front end of the spring is compressed to generate a preloading force. Late stroke: from the step portion of the front end of the screw remain in pressure contact with a cored spring stop piece until the end of the pull-rivet stroke, the spring is compressed from the front end to form a preloading force.

JP3993844 and US0060189787 use different auxiliary mechanisms to apply pre-loading force to the early and late strokes of the thread transmission, solving the same problem of preloading force of re-entry during the thread transmission. Although JP3993844 uses a spring less than US0060189787, taking into account the preload, the patent JP3993844 may be a deteriorated design of US0060189787, because the late stroke of pull-rivet in JP3993844 is fixed and does not vary with the changes of the spring length and may be shorter than the stroke of the late stroke in US0060189787.

Continue to investigate the middle stroke of pull-rivet in JP833844 and US0060189787 under different working conditions: middle stroke condition 1: In the middle of the normal pull-rivet stroke, there is no pre-loading auxiliary mechanism in the thread transmission mechanisms in the above two patents. In the early period of pull-rivet stroke, before the surface of the claw core is in contact with the rivet tail rod, the power tool overcomes the frictional force of the exiting screw pair to make the inner tube retreat relative to the drive shaft under the reaction force of the guiding nozzle against the claw until the surface of the claw core is in contact with the surface of the rivet tail rod, and the claw bites the rivet tail rod. At this time, since the pre-compression amount of the spring does not change any more, the spring force generated by the pre-compression amount of the spring has completely become the internal force of the inner tube of the moving part. When the front end of the claw remains in contact with the rear end of the guiding nozzle, but the axial interaction force is reduced to zero, it is an axial zero pressure contact. At the beginning of the middle period of the pull-rivet stroke, the external force of the inner tube of the moving part is released, and the screw pair on the transmission mechanism is still the exiting screw pair, and the active part needs to continue to rotate after a "idle return" stroke so that the screw pair is transferred to the other side of the thread and becomes a pull-rivet screw pair. This screw pair conversion is a passive conversion under axial displacement constraints. The "idle return" stroke size is determined by the axial clearance between the threads, but the wear of the threads during threading increases the axial clearance of the threads.

Middle stroke condition 2: during the use of the tool, the operation direction will be changed according to the actual work needs or abnormal conditions. Then, the reverse operation problem in the middle stroke of the thread transmission is further investigated, that is, the shifting problem in the pull-rivet stroke. In this case, the power tool shifting reverse operation means that the screw transmission mechanism needs to perform screw pair conversion before steering in the conventional riveting tool chuck (see JP3993844 and US0060189787). When the power tool rotates and drives the active part of the screw transmission mechanism to rotate in the reverse direction, the axial pressure on the screw pair is the reaction force generated by the elastic deformation or plastic deformation of the blind rivet. The power tool reversely rotates to release the pressure at the contact surface of the rivet and the guiding nozzle until the axial pressure on the screw pair becomes 0, then the rotary power tool continues to reverse the rotation to release the rivet screw pair, and the screw pair conversion is completed after the "idle return" stroke. After the screw pair is formed, the active component can then drive the driven component to reverse operation, so in this case the screw pair conversion is also passively converted under axial displacement constraints. When the conversion of the screw pair has been completed, if it is required to change the steering of the power tool back to the original operation direction in any position of the middle stroke, it is necessary to perform the screw pair conversion first according to the previous analysis, which is also passively implementing the conversion under axial displacement constraints and has a "idle return" stroke problem.

Middle stroke condition 3: if the work requires large-size rivets, the blind rivet tool needs to replace the guiding nozzle. The large-size rivet means larger diameter of the rivet tail rod, so the core hole of the guiding nozzle needs to be enlarged. Accordingly, the tail of the guiding nozzle needs to be appropriately lengthened so that the claw pieces are further retracted into the claw sleeve to form a larger space to allow for the blind rivet having a tail rod with a larger diameter. In the conventional riveting tool chuck (see JP3993844 and US0060189787), since the length of the guiding nozzle tail becomes longer, comparing to middle stroke condition 1, the location of the screw pair correspondingly moves back an axial length equal to the increased length of the guiding nozzle tail. But it is also the passive conversion under axial displacement constraints and also has a "idle return" stroke problem.

Based on the above analysis, it can be seen from the middle stroke condition 1, the middle stroke condition 2 and the middle stroke condition 3 that the thread transmission mechanism on the conventional riveting tool chuck (see JP3993844 and US0060189787) does not have an auxiliary mechanism to provide a preloading force during the middle period between the early period and later period of the thread transmission stroke. In the middle stroke condition 1 of the pull-rivet, there is a "idle return" stroke due to the axial clearance between the threads from exiting tail rod and releasing the screw pair to forming the pull-rivet screw pair; since there is no preloading force of the pull-rivet screw pair during the pull-rivet middle stroke, there is "idle return" stroke problem if the rotary power tools require one or more times back and forth shifting operation during the pull-rivet middle stroke 2. Pull-rivet middle stroke condition 3 is similar to condition 1, but the position of the screw pair conversion changes in accordance with the size of the guiding nozzle size. Due to the lack of preloading auxiliary mechanism in the thread transmission mechanism during the pull-rivet middle stroke, JP3993844 and US0060189787 have the following problems: there is no preloading auxiliary mechanism in the thread transmission mechanism at the starting position the of the middle period of the normal pull-rivet stroke. The screw pair is passively converted under axial displacement constraints, and there is a "idle return" stroke during the screw pair conversion. If the power tool shifts to change the movement direction during the pull-rivet stroke, there is also a "idle return" stroke when the thread transmission mechanism is operated in the reverse direction during the stroke because due to the lack of the preloading auxiliary mechanism. The thread transmission mechanism does not have an auxiliary mechanism that compensates for thread wear. The problems of "idle return" stroke and thread wear compensation can seriously affect the transmission efficiency, transmission accuracy and reliability of the thread transmission mechanism, resulting in the effective pull force of the tool, converted from the power tool under the anti-rotation clamping condition of a certain external force, is not large enough. The tool is underperformance especially in large stainless-steel blind rivets with high pull-rivet strength or high-strength carbon steel blind, which limits the scope of its application. The riveting tool chuck in US006018978 has been in existence for nearly 20 years. The above problems have not been effectively solved. JP3993844 does not solve the above problems in essence, but these problems can seriously affect the value, function and application of such products.

SUMMARY OF THE INVENTION

The object of the present invention is to provide a riveting tool chuck with a good structure. The chuck is adapted to a driving device with a power output and can provide a screw pair pre-loading force without an idle return stroke.

Another object of the present invention is to provide a riveting tool with a good structure design, may be provided screw pair preload, without idle return stroke of the riveting tool.

In order to achieve the above object, the present invention adopts the following technical solution: a riveting tool chuck, including a cylindrical handle, which is provided with a rotating part through the cylindrical handle, the rotating part is positioned axially and rotatably circumferentially connected to the cylindrical handle; And a transmission part that is circumferentially positioned and axially movably connected to the cylindrical handle, wherein the rotating part and the transmission part are connected by a threaded structure, and a plurality of claws distributed in the circumferential direction and a limiting structure capable of preventing the claws from being detached are arranged at the front end of the transmission part, wherein the front end of the cylindrical handle is provided with a cylindrical guiding nozzle making the front end of each claw against the rear end thereof, and between the front end of the transmission part and the rear end of each claw are provided with a claw top column, the claw top column can push the transmission part to move forward axially so that the claws are radially separated under the cooperation of the cylindrical guiding nozzle when the rotating part is reversed, and can drive the transmission part to move axially backwards so that the claws are radially gathered and continue to move axially backwards when the rotating part rotates forward, wherein: a safety valve mechanism enabling the threaded structure to have a screw pair pre-loading force is arranged between the claw top column and the transmission part, and the safety valve mechanism enables the screw pair conversion of the threaded structure to be performed before the axial reaction force between the front end of each claw and the rear end of the cylindrical guiding nozzle is reduced to zero during the forward rotation of the rotating part, thereby avoiding the idle return stroke of the thread structure.

In the above-mentioned riveting tool chuck, the rotating part is a screw, the transmission part is a cylinder, and the front end of the screw and the rear end of the cylinder can be connected by the threaded structure; the safety valve mechanism comprises a valve core, the valve core is arranged in the cylinder and acted as a block in the middle of the cylinder, and a spring arranged between the valve core and the claw top column. The spring acts on the claw top column on one end and acts on the valve core on the other end. A valve cavity is formed between the screw, the cylinder and the valve core, the volume of the valve cavity can change according to the axial relative position of the screw and the cylinder to change the pressure inside.

In another aspect, in the above-mentioned riveting tool chuck, the rotating part has a screw hole, the transmission part has a threaded post, and the screw hole and the threaded post can be screwed; the safety valve mechanism comprises an axial through hole disposed on the transmission part and a valve core disposed in the axial through hole and acted as a block in the middle of the axial through hole, wherein the valve core and the claw top column are provided with a spring, one end of the spring acts on the claw top column, and the other end acts on the valve core, and the rotating part, a valve cavity is formed between the screw, the cylinder and the valve core, the volume of the valve cavity can change according to the axial relative position of the screw and the cylinder to change the pressure inside.

As another solution, in the above-mentioned riveting tool chuck, the safety valve mechanism is a one-way safety valve mechanism, and when the pressure in the valve cavity is greater than the spring pre-loading force, the valve core can be pushed open to relieve pressure.

In the above-mentioned riveting tool chuck, the safety valve mechanism is a two-way safety valve mechanism, and a low-pressure overload protection safety valve is provided on the safety valve mechanism, and the low-pressure overload protection safety valve is capable of increasing the pressure when the pressure in the valve cavity is less than a set value, and push the valve core open to relieve pressure when the pressure in the valve cavity is greater than the spring preloading force.

In the above-mentioned riveting tool chuck, the safety valve mechanism is a pressure adjustable safety valve mechanism or a fixed pressure safety valve mechanism, and if the safety valve mechanism is a fixed pressure safety valve mechanism, a pre-loading spring is arranged between the transmission part and the cylindrical handle; the valve cavity is provided with a medium, and the medium is a gas or a fluid.

In the riveting tool chuck, the cylindrical handle is provided with an annular groove in the rear end, and the annular groove is provided with an elastic sleeve ring, the rear end surface of the cylindrical handle is provided with at least one avoidance observation notch.

In the riveting tool chuck, the cylindrical guiding nozzle is provided on the front outer sleeve, the front outer sleeve is detachably secured in the front end of the cylindrical handle, and the front outer sleeve is detachably coupled to a locking ring that abuts against the front end surface of the cylindrical handle.

In the riveting tool chuck, the cylindrical guiding nozzle uses a detachable structure to connect to the front outer sleeve so that the front outer sleeve can be connected to any one of cylindrical guiding nozzles with different apertures.

In the riveting tool chuck, the guiding nozzle comprises a cylindrical rear portion provided in the front outer sleeve and allowing the front end of each claw to lean against thereon, and a rotary table rotatably connected to the front end of the front outer sleeve. The cylindrical rear portion and the front outer sleeve are connected in a detachable manner or form as integral. The rotating shaft of the rotary plate is eccentrically disposed with the central axis of the cylindrical rear portion, and the rotary plate is provided with a plurality of pull-rivet apertures with different sizes, the center of each pull-rivet aperture is located on the same circumference and the central axis of each pull-rivet aperture can respectively coincide with the central axis of the cylindrical rear portion when the rotary plate is rotated, and a positioning structure is disposed between the rotary plate and the front outer sleeve.

In the riveting tool chuck, the front outer sleeve is provided with at least one opening; the front outer sleeve is provided with a transparent protection cover closing the opening.

In the riveting tool chuck, the transparent protection cover is provided with at least one operation hole, and when the transparent protection cover rotates, at least one operation hole and at least one opening can be arranged opposite.

In the riveting tool chuck, the limiting structure comprises a claw sleeve, the claw sleeve is fixed to the front end of the transmission part, and the claw sleeve is provided with a central through hole and each claw passes through the central through hole. The inner wall of the central through hole is slidably engaged with the outer side surface of the claw through an inclined surface.

In the riveting tool chuck, the front end of the claw top column has a curved surface, the rear end of each claw has a tapered surface, and the curved surface of front end of the claw top column and the tapered surface of the rear end of each claw fit each other; the rear end of the cylindrical guiding nozzle has a tapered surface, and the front end of each claw has a tapered surface, and the tapered surface of the front end of each claw and the curved surface of the rear end of the cylindrical guiding nozzle fit each other.

In the riveting tool chuck, when each claw is radially fully opened, the distance between the front end of the valve core and the rear end of each claw is less than the length of the tail rod of the riveting fastener remaining in the cylindrical handle.

A riveting tool using the above-described riveting tool chuck, comprising a driving device, the riveting tool chuck being connectable to the driving device, and a power output shaft of the driving device is connected to the rotating part, the driving device is an electric drive or a manual drive.

Compared with the prior art, the advantages of the riveting tool chuck and the riveting tool are:

1. During the pull-rivet stroke, JP3993844 and US0060189787 respectively use different spring systems to solve the pre-loading problem of the screw drive exit and re-entry in the early and late pull-rivet strokes. This present invention is based on the spring preloading. By using the safety valve mechanism, the interaction between the pressure of the safety valve mechanism and the spring preloading force causes the threaded structure to be preloaded in the whole process of the pull-rivet stroke, effectively solving the problem that there is no auxiliary mechanism to provide pre-loading force in the middle pull-rivet stroke of the traditional design tool.
2. The screw pair is automatically converted and then automatically pre-loaded under the action of the axial force. There is no problem of the idle return stroke in the JP3993844 and US0060189787, which can effectively eliminate the negative effects on transmission efficiency, precision and reliability caused by axial clearance of the threads.
3. The maximum allowable working pressure of the safety valve mechanism is determined by the pre-compression of the spring. The structure is configured to adjust the maximum threshold pressure in a fixed manner by adjusting the pre-compression of the spring. On the basis of fact that JP3993844 uses one less spring than US0060189787, the present invention uses the pre-loading spring with another two safety protection functions: the maximum working pressure of the safety valve mechanism is restricted and the maximum preloading force of the screw pair in the middle period of the pull-rivet stroke is restricted.
4. In the pull-rivet stroke, the medium in the safety valve mechanism is pressurized by the transmission part to perform the automatic conversion of the screw pair, which is more reasonable and effective than the patent JP 3993844 and the patent US0060189787.
5. The pre-loading force on the screw pair can automatically compensate the thread wear occurring during the pull-rivet work.
6. The pre-loading force on the screw pair can effectively reduce the impact of the strong change of the load on the transmission thread structure when the riveting fastener tail rod is pulled off
7. The medium in the valve cavity can buffer various impact loads in the pull-rivet stroke to a certain extent, which is beneficial to improve stability and reliability.
8. In addition to the benefits of the safety valve mechanism, by purposely adjusting the maximum preload of the screw pair according to the blind rivet specifications, the maximum preloading force in the screw pair can be accurately adjusted and controlled according to the actual working load. Therefore, it is more beneficial to improve the ability of the rivet tool chuck to resist different impact loads, and also to improve the stability, reliability and life of the tool.

DRAWINGS

Figure 1:
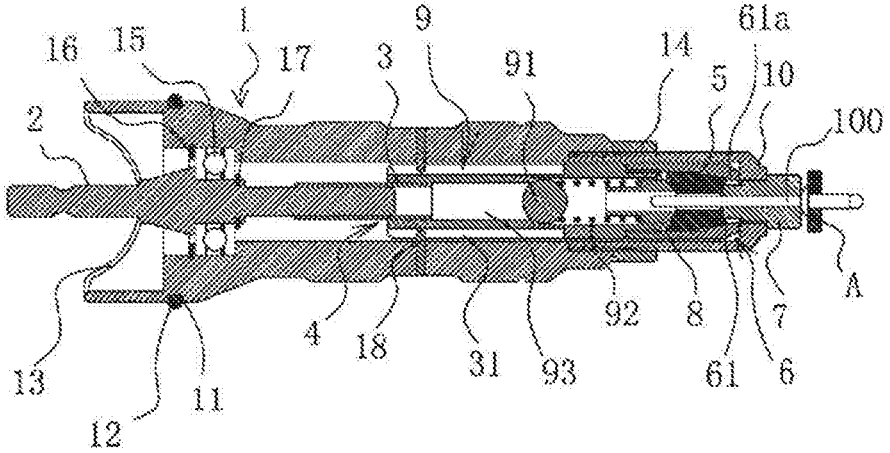
FIG. 1 is a structural schematic view showing the riveting fastener loading stage according to the present invention.
Figure 2:
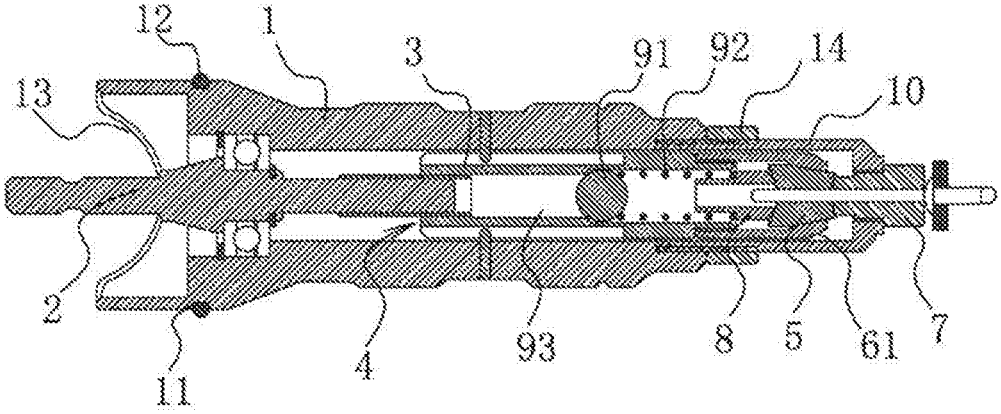
FIG. 2 is a structural schematic view showing the pull-rivet state according to the present invention.
Figure 3:
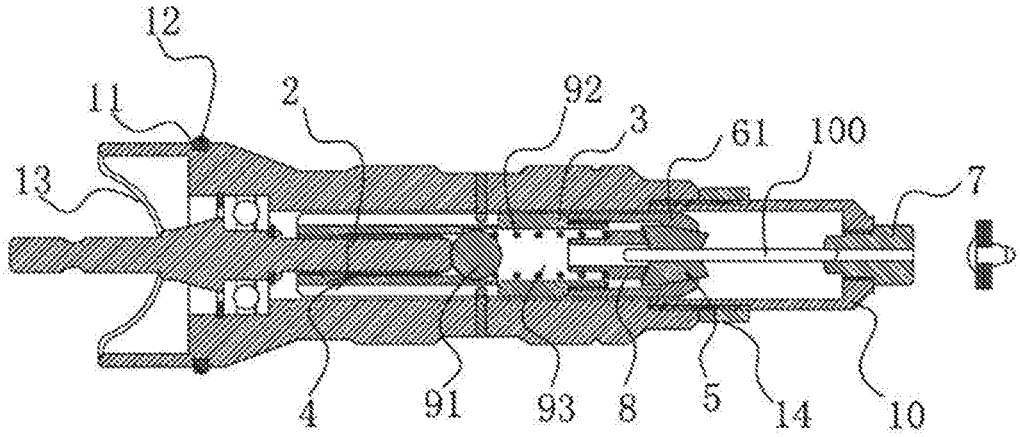
FIG. 3 is a structural schematic view showing the core-pulling state according to the present invention.
Figure 4:
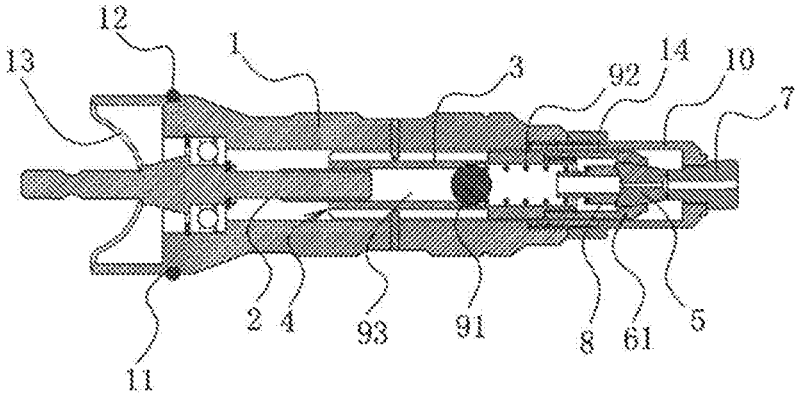
FIG. 4 is a structural schematic view showing the riveting fastener tail rod according to the present invention.

Among them, cylindrical handle 1, annular groove 11, elastic ring 12, avoidance observation notch 13, locking ring 14, bearing 15, C-shaped retaining spring 16, E-type retaining spring 17, anti-rotation limit pin 18, rotating part 2, transmission part 3, strip slot 31, threaded structure 4, claw 5, limiting structure 6, claw sleeve 61, central through hole 61*a*, cylindrical guiding nozzle 7, claw top column 8, safety valve mechanism 9, front outer sleeve 10, opening 101, transparent protection cover 102, operating hole 102*a*, valve core 91, spring 92, valve cavity 93, axial through hole 94, overload protection safety valve 95, riveted fastener tail rod 100, drive device 20, blind rivet A.

DETAILED DESCRIPTION OF THE INVENTION

The following are invention embodiments and the accompanying drawings of the specific embodiment of the present invention, the technical solution will be further described, but the present invention is not limited to these embodiments.

Embodiment 1

As shown in FIG. 1-4, the riveting tool chuck includes a cylindrical handle 1, which is provided with a rotating part 2 through the cylindrical handle 1, the rotating part 2 is positioned axially and rotatably circumferentially connected to the cylindrical handle 1; and a transmission part 3 that is circumferentially positioned and axially movably connected to the cylindrical handle 1, wherein the rotating part 2 and the transmission part 3 are connected by a threaded structure 4, and a plurality of claws 5 distributed in the circumferential direction and a limiting structure 6 capable of preventing the claws 5 from being detached are arranged at the front end of the transmission part 3, wherein the front end of the cylindrical handle 1 is provided with a cylindrical guiding nozzle 7 making the front end of each claw 5 against the rear end thereof, and between the front end of the transmission part 3 and the rear end of each claw 5 are provided with a claw top column 8, the claw top column 8 can push the transmission part 3 to move forward axially so that the claws 5 are radially separated under the cooperation of the cylindrical guiding nozzle 7 when the rotating part 2 is reversed, and can drive the transmission part 3 to move axially backwards so that the claws 5 are radially gathered and continue to move axially backwards when the rotating part 3 rotates forward. A safety valve mechanism 9 enabling the threaded structure 4 to have a screw pair pre-loading force is arranged between the claw top column 8 and the transmission part 3, and the safety valve mechanism 9 enables the screw pair conversion of the threaded structure 4 to be performed before the axial reaction force between the front end of each claw 5 and the rear end of the cylindrical guiding nozzles 7 is reduced to zero during the forward rotation of the rotating part 2, thereby avoiding the idle return stroke of the thread structure 4.

Figure 5:
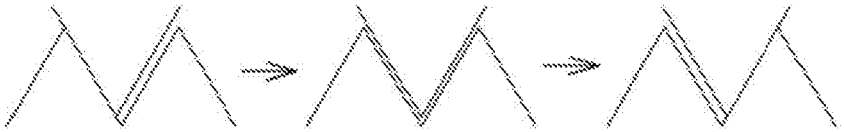
FIG. 5 is a diagram showing the screw pair conversion process according to the present invention.

As shown in FIG. 5, it is a diagram showing the screw pair conversion process according to the present invention. The left side is a schematic diagram when the first screw pair is in contact, the middle is a schematic diagram during the screw pair conversion process, and the right side is a schematic diagram when the second screw pair is in contact.

Specifically, a bearing 15, preferably a planar thrust bearing, is disposed between the rotating part 2 and the cylindrical handle 1, and a C-shaped retaining spring 16 and an E-shaped retaining spring 17 are respectively disposed on both sides of the bearing 15 to position the bearing 15 axially. At least one axially extending strip slot 31 is formed in the transmission part 3, and at least one radially extending anti-rotation limit pin 18 is fixed to the cylindrical handle 1. The anti-rotation limit pin(s) 18 is disposed in one-to-one correspondence with the strip slot(s) 31 and the end of the anti-rotation limit pin 18 is located in the strip slot 31. Preferably, the end portion of the anti-rotation limit pin 18 has a circular arc shape, and the groove bottom of the strip slot 31 has an arc shape, and the end portion of the anti-rotation limit pin 18 is in sliding contact with the groove bottom of the strip slot 31.

In this embodiment, the rotating part 2 is a screw, the transmission part 3 is a cylinder, and the front end of the screw and the rear end of the cylinder can be connected by the threaded structure 4; the safety valve mechanism 9 comprises a valve core 91, the valve core 91 is arranged in the cylinder and acted as a block in the middle of the cylinder, and a spring 92 arranged between the valve core 91 and the claw top column 8. The spring 92 acts on the claw top column 8 on one end and acts on the valve core 91 on the other end. A valve cavity 93 is formed between the screw, the cylinder and the valve core 91, the volume of the valve cavity 93 can change according to the axial relative position of the screw and the cylinder to change the pressure inside. The safety valve mechanism 9 is a pressure adjustable safety valve mechanism or a fixed pressure safety valve mechanism, and a pre-loading spring is provided between the transmission member 3 and the cylindrical handle 1 when the safety valve mechanism 9 is a fixed pressure type safety valve mechanism; the valve cavity 93 is provided with a medium, the medium is a gas or a fluid, and if there is a loop system, other types of medium may be used. To make the valve core 91 act as a block in the middle of the cylinder, an annular step is formed as a valve seat for the valve core 91. In the present embodiment, the safety valve mechanism 9 is a one-way safety valve mechanism, and when the pressure in the valve cavity 93 is greater than the preloading force of the spring 92, the valve core 91 can be pushed open to relieve pressure.

The safety valve mechanism 9 is a device for thresholding the working pressure of the medium in the valve cavity 93. The medium pressure in the valve cavity 93 is mainly derived from the change of the medium temperature, the increase or decrease of the medium in the volume of the valve cavity 93, or the volume/temperature changes caused by pressuring/decompressing device working on quantitative medium in the volume of the closed valve cavity 93. The one-way spring pre-loading safety valve mechanism 9 is a type of safety valve. The one-way spring pre-loading safety valve mechanism utilizes the force of the compression spring to balance the force exerted by the medium on the valve core 91. The limit of the safety valve mechanism allows the pressure threshold to be determined by the preloading compression of the spring. When the force of the medium in the valve cavity on the valve core is less than the force of the pre-pressure spring on the valve core, the valve core is in a closed state; when the force of the medium in the valve cavity on the valve core is greater than the force of the pre-pressure spring on the valve core, the spring is compressed to cause the valve core to leave the valve seat, and the valve is automatically opened; when the force of the medium in the valve cavity on the valve core is less than the spring pre-loading force, the pressure of the pre-pressure spring pushes the valve core back to the valve seat, and the valve is automatically closed.

According to the different direction of the force of the pre-loading spring to the valve core, the spring preloading safety valve mechanism can be divided into a low-pressure protection safety valve and a high-pressure protection safety valve. Since the force of the spring on the valve core is one-way, such spring preload safety valve mechanisms can be collectively referred to one-way safety valves. When the pre-loading spring is embedded outside the pressure cavity of the safety valve, the function of the safety valve mechanism is high-voltage overload protection; when the pre-pressure spring is embedded in the safety valve cavity, and the pressure overload protection means the low-voltage overload protection. Typically, the safety valve core has a passage connected to the pressure outlet on the side of the preload. According to the pre-loading spring embedded position, the pre-loading pressure type safety valve can be divided into a low-pressure protection safety valve and a high-pressure protection safety valve, but only functions as a one-way pressure overload protection. The safety valve can be divided into a pressure-adjustable safety valve and a fixed-pressure safety valve according to whether the compression amount of the pre-loading spring is variable. The preloaded pressure safety valve mechanism is light and compact, has high sensitivity, is unrestricted in installation position. Due to its low sensitivity to vibration, it can be used on mobile devices in addition to fixing devices or pipes. The one-way preloaded pressure safety valve is widely used as a safety device for overpressure (low pressure or high pressure) protection in various related industries. If the valve has both a low pressure and high-pressure protection, the safety valve is a two-way safety valve. In this case, the working pressure of the medium in the valve cavity connected with the two-way safety valve will be defined in a certain pressure threshold range. The valve core will close when the medium operating pressure is within the threshold range; the valve core will automatically open when the working pressure of the medium exceeds the threshold range; when the working pressure of the medium returns to the threshold range of the safety valve, the valve core will automatically return to the seat. Regarding the structural design of the two-way safety valve, there are usually directional or other specific requirements for installation.

Figure 8:
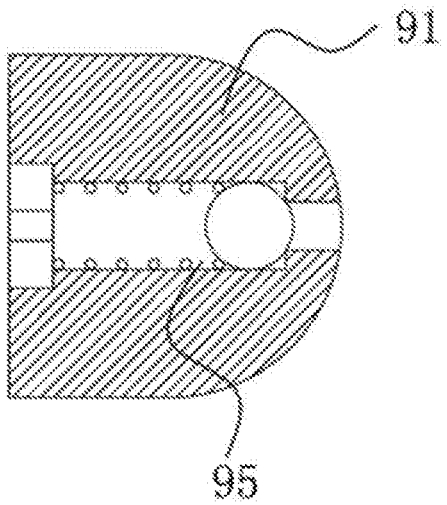
FIG. 8 is a partial structural view of the two-way safety valve according to the present invention.

Obviously, in the present invention, the safety valve mechanism 9 can also be a two-way safety valve mechanism. As shown in FIG. 8, the safety valve mechanism 9 is provided with a low-pressure overload protection safety valve 95 configured to increase the pressure in the valve cavity 93 when the pressure in the valve cavity 93 is less than a set value, and push the valve core 92 open to relieve pressure when the pressure in the valve cavity 93 is greater than the preload of the spring 92.

The limiting structure 6 includes a claw sleeve 61 fixed to the front end of the transmission part 3, and the claw sleeve 61 is provided with a central through hole 61, and each of the claws 5 is disposed at the center through hole 61*a*, the inner wall of the center through hole 61*a* and the outer side surface of the claw 5 are slidably fitted by a inclined surface. The front end of the claw top column 8 has a curved surface, the rear end of each claw 5 has a tapered surface, and the curved surface on the front end of the claw top column 8 can fit with the tapered surface at the rear end of each claw 5; The rear end of the cylindrical guide 7 has a tapered surface, and the front end of each of the claws 5 has a tapered surface, and the tapered surface of the front end of each of the claws 5 can fit with the curved surface of the rear end of the cylindrical guiding nozzles 7.

The rear end surface of the cylindrical handle 1 is provided with at least one avoidance observation 13. The cylindrical guiding nozzle 7 is disposed on the front outer sleeve 10, and the front outer sleeve 10 is detachably fixed to the front end of the cylindrical handle 1, and the front outer sleeve 10 is detachably coupled with the locking ring 14 abut against the front end surface of the cylindrical handle 1. The cylindrical guiding nozzle 7 is coupled to the front outer sleeve 10 by a detachable structure to allow the front outer sleeve 10 to be coupled to any one of the cylindrical guiding nozzle(s) 7 having different apertures.

The invention is described in more detail below:

The present invention generally comprise steps such as inserting riveting fasteners (blind rivets), pulling rivet, pulling core and exiting riveting fasteners tail rod, etc. The pull-rivet mechanical process comprises two stages: First, to overcome the material yield limit of the front thin walled cylinder of the riveting fasteners to make it deform; second, to overcome the tensile limit of the core rod to forcibly pull off the core rod of the riveting fastener and pull away the tail rod 100 of the riveting fastener. Since the riveting fastener (blind rivet) has a long stroke of pull-rivet, the riveting force required for the work varies with the specification or material of the blind rivet, and the greater the strength of the material, the more the riveting force required for the blind rivet Large, the larger the size of the blind rivet of the same material, the greater the riveting force required, so the common light, medium and heavy riveting tool chucks are mainly categorized according to the riveting ability of the tool. More attention is drawn to ease of use, riveting consistency, riveting capability and riveting efficiency of the riveting tool chuck.

From the above-mentioned background technology analysis, if the "idle return" problem of the middle stroke of pull-rivet and the thread wear are solved through the axial working load design and the transmission, therefore improving the pull-rivet ability of the riveting tool chuck, and with the advantage of the product itself, the riveting tool chuck will become a popular product in the market that meets the needs and has obvious functional edges.

On the problem of insufficient pull-rivet force of the existing riveting tool chuck on the market under certain external anti-rotation clamping conditions, one of the solutions is to try to improve the existing structure, material, process, surface treatment, strength and machining precision of the product, while the improvement effect needs to be verified; another Try to improve at equal angles, but the improvement space needs to be verified; the other solution is to introduce a new mechanism that can improve the transmission efficiency based on the working principle of the mechanism, and solve the problem of transmission efficiency, accuracy and reliability caused by "idle return" stroke and thread wear through the axial working load design and transmission, and it is not easy. The primary basic condition of the safety valve mechanism structure is that there should be a valve cavity that can withstand a certain pressure load. The pressure threshold of the medium in the valve cavity is determined by the pre-loading force of the pre-loading spring, and affected by the medium pressure source, the medium transmit the pressure to the pre-loading spring in the cavity, and the safety valve is opened when the valve is overloaded, which plays the role of automatic protection of the threshold pressure. In traditional mechanical design, if the mechanism moves in a closed cavity, it will generate non-designed or uncontrollable changes in medium pressure and medium temperature. For safety reasons, the close cavity is usually modified to a zero-pressure design with a pressure outlet in structural. Such design of the structure is seen in the design of the blind rivet tool chuck (see JP3993844 and US0060189787). The safety valve mechanism has a controllable medium pressure in the valve cavity, high sensitivity, and is itself a safety component. According to the working characteristics and structural characteristics of the riveting tool chuck, on the basis of the patent JP3993844 and the patent US0060189787, the re-entry problem in the screw transmission has been solved, and the present invention focuses on solving the problem of "idle return" stroke and thread wear cannot be compensated when the screw pair is converted in the middle period of pull-rivet stroke, and put forward specific implementation solutions.

The valve cavity is formed between the screw, the cylinder and the valve core in this embodiment. The pressurizing and decompressing device is a screw connected to the rotary drive device having the power output and is engaged with the cylinder by the threaded structure. Taking into account cost, heat dissipation, stiffness, correct opening of the valve, returning to the seat and its performance requirements, the valve core can adopt a rigid or elastic sphere, a hemisphere or the like, or other cylinders and sleeves without a pressure outlet structure, or any flat plates, sleeves and cylinders having a different surface structure on its upper surface in the present invention. By doing so, when there is external force or the medium pressure inside the valve cavity is greater than the pressure applied to the valve core by the compression preload of the compression pre-loading spring, automatic opening and closing action can be performed.

The pull-rivet stroke is divided into the early period, the middle period and the late period to examined respectively. The middle period of the pull-rivet stroke in different working conditions is the key point to be examined:

Early period: At the end of the operation of exiting the riveting fastener tail rod, the claw and the claw top column are retracted to the limit position, the claw is in the fully open state, and the claw sleeve is at the extreme end position, and a cylindrical space slightly larger than the pull-rivet apertures of the guiding nozzle is formed between each claw core portion to allow the riveted fastener tail rod 100 to be exit or a new riveted fastener to be inserted, the end of the stroke of the riveted fastener tail rod 100 exiting is also the starting point of the pull-rivet stroke. The front end surface of the claw maintains axial pressure contact with the rear end surface of the cylindrical guiding nozzle, and the screw completely exits the threaded area of the cylinder internal thread and is in pressure contact with the cylinder, and is in a static equilibrium state. After inserting the rivet, the screw starts to rotate under the driving tool, the screw enters the threaded area, and the pull-rivet stroke starts. At this time, the screw pair is still the exiting screw pair in the stroke of exiting the rivet tail rod. During the pull-rivet stroke of the riveting tool chuck, the screw driving mechanism first performs the screw pair conversion, and then the riveting load can be loaded for the riveting. Since the front of the screw in the safety valve mechanism is to pressurize and depressor the medium in the valve cavity, the screw rotates to pressurize the medium in the valve cavity to form a new internal force system. Before the inner surface of each claw is in contact with the rivet core rod, the driving device needs to overcome the frictional force of the current exiting screw pair to make the cylinder under the pre-loading force between the cylindrical guiding nozzle and the claw top column to move backward linearly relative to the screw. The pressure of the medium in the valve cavity of the safety valve mechanism acts on the parts thereof as internal forces. Due to the properties of internal forces is a pair of equal and opposite force, the axial section of the screw is subjected to the pressure of the medium in the valve cavity, and the axial section of the bottom of the cylinder is subjected to an equal and opposite pressure. According to the force balance principle, the axial pressure of exiting the screw pair is reduced as the pressure of the medium in the valve cavity of the safety valve structure increases. When the friction of exiting the screw pair becomes 0, the axial pressure of exiting the screw pair is also 0. The screw continues to rotate, and the pressure in the valve cavity in the safety valve structure continues to increase, and the contact surface of the exiting screw pair starts to disengage and form the pull-rivet screw pair by the combined force of the axial external forces. At the end of the previous stroke, the front end of the claws and the rear end of the cylindrical guiding nozzles keep zero pressure contact, and the screw pair conversion has completed. Since the medium in the valve cavity has been pressurized, if the pressure in the valve cavity is greater than the pressure the pre-loading spring acts on the valve core, the valve core will automatically leave the valve seat and perform automatic pressure relief. In this case, if the drive device continues to rotate the screw in the same direction, the working pressure of the valve cavity will remain at the maximum threshold pressure.

2 Middle period stroke condition 1: When the friction force of the exiting screw pair is 0, the screw continues to rotate, and the contact surface of the exiting screw pair begins to disengage. When the frictional force of the exiting screw pair is 0, the axial pressure is 0, the front end of the claws and the rear end of the guiding nozzles remain pressure contact. The crew continues to rotate and the pressure in the valve cavity continues to increase, and the screw pair completes the screw pair conversion by the combined force of these two external forces. When the contact pressure between the front end surface of the claws and the rear end surface of the cylindrical guiding nozzles drops to 0, the middle period stroke starts, and the pull-rivet screw pair is automatically formed and automatically pre-loaded, so there is no "idle return" of thread structure in the prior art. The pre-loading force can automatically compensate the thread wear, eliminating the negative impact on the thread axial clearance by the inevitable thread wear during the thread transmission process. Since the medium in the valve cavity has been pressurized, if the pressure in the valve cavity is greater than the pressure the pre-loading spring acts on the valve core, the valve core will automatically leave the valve seat and perform automatic pressure relief. In this case, if the drive device continues to rotate the screw in the same direction, the working pressure of the valve cavity will remain at the maximum threshold pressure.

3 Middle period stroke condition 2: during the use of the tool, the operation direction will be changed according to the actual work needs or abnormal conditions, then the reverse operation problem, that is, the shifting in the pull-rivet stroke problem. At this time, the rotation driving device shifting reverse operation, in the conventional crimping tool chuck (see JP3993844 and US0060189787), means that the thread structure needs to perform the screw pair conversion before reversing. In the present invention, since the valve cavity has the compressed medium, when the driving device shifts and drives the screw to rotate reversely, the axial pressure on the screw pair is the reaction force generated due to the elastic or plastic deformation of the blind rivet, and the pressure of the compressed medium in the valve cavity. When the driving device continues to rotate reversely and loosen the pressure on the contacting surface of the rivet and the cylindrical guiding nozzles, the axial pressure source becomes the compressed medium. In this case, the rotary driving device need to overcome the frictional force on the screw pair to continue to reverse the screw, but the pull-rivet screw pair is not released until the axial pressure becomes zero. The position that the axial pressure on the pull-rivet screw pair becomes 0 is the point that the pressure between the rear end surface of the cylindrical guiding nozzles and the front end surface of the claws is equilibrium with the pressure of the medium in the valve cavity, which is the starting point of the middle period stroke. If the driving device is switched back to the original direction of rotation at any of the positions during the middle period stroke, there is no screw pair conversion involved, and the thread structure can directly perform the rotation with the driving device, and there is no "idle return" stroke at all. Since the medium in the valve cavity has been pressurized, if the pressure in the valve cavity is greater than the pressure that pre-loading spring acts on the valve core, the valve core will automatically leave the valve seat and perform automatic pressure relief. In this case, if the drive device continues to rotate the screw in the same direction, the working pressure of the valve cavity will remain at the maximum threshold pressure; if the screw is rotated in the reverse direction, the valve body will return to the valve seat, closing the safety valve, the valve cavity internal pressure is reduced as the driving device rotates.

4 Middle period stroke condition 3: The pre-loading spring is connected with the claw top column, the claw top column is connected with the claw, the claw sleeve is externally connected with the cylinder. The claws, the claw top column, the spring, and the valve core are connected in order and included in an inner cavity formed by the claw sleeve and the cylinder, and the claw top column is movable when working. The front end of the spring is connected with the claw top column. If the diameter of the tail rod of the installed blind rivet is increased, the claw and the claw top column need to be more inwardly retracted into the cavity of the claw sleeve, and the compression amount of the spring is increased and preloading force increases correspondingly, so the preloading force remains the same before and after, i.e. the maximum allowable pressure threshold in the valve cavity becomes large as the pre-loading compression amount of the spring increases. The blind rivet tail rod is one of the key adjustment components of the pre-loading pressure adjustable safety valve mechanism when the blind rivet chuck is working during pull-riveting. The larger the size of the blind rivet is, the larger the diameter of the blind rivet tail rod becomes, and during working, since the claws are retracted to the claw sleeve to clamp the blind rivet of this size and correspondingly the displacement of the claws becomes larger; the front portion of the claw top column is connected with the tail portion of the claws, the displacement of the claw top column relative to the valve core also becomes larger; the tail portion of the claw top column is connected with the pre-loading spring, so the compression amount of the spring disposed between the claw top column and the valve core, thereby achieving the object of mechanically and quantitatively regulating the maximum allowable pressure threshold in the valve cavity according to the blind rivet specification. Larger size blind rivets of the same material require greater pull-rivet load, if the medium pressure in the valve cavity exceeds the maximum allowable threshold, then the allowable pressure threshold may be increased to increase the maximum preloading force of the pull-rivet screw pair. It is more conducive to have a larger preloading force within the allowable range, thereby reducing the impact on the thread structure due to the rapid change of load when the tail rod of high strength and large-sized rivet is pulled off by a large pull-rivet force. Since the medium in the valve cavity has been pressurized, if the pressure in the valve cavity is greater than the pressure the pre-loading spring acts on the valve core, the valve core will automatically leave the valve seat and perform automatic pressure relief. In this case, if the drive device continues to rotate the screw in the same direction, the working pressure of the valve cavity will remain at the maximum threshold pressure 5 Late period: After the front end surface of the screw contacts the valve core, the driving device continues to rotate, and the front end of the screw will open the valve core to cause the valve core to leave the valve seat. At this time, the safety valve mechanism begins to relieve pressure until the end of the pull-rivet stroke. At this point, the front end face of the screw is in point pressure contact with the valve core, so there is no re-entry problem.

The threaded structure of the safety valve mechanism introduced into the riveting tool chuck increases the load of the rotary driving device and the thread wear of the threaded structure in the riveting tool chuck to a certain extent, but these negative effects are controllable to some extent and within acceptable limits. From the comparison and analysis of the early, middle and late period of the pull-rivet stroke, especially different conditions of the middle period of the pull-rivet above, by using a built-in adjustable valve mechanism design, the present invention not only effectively solves the problems to be resolved during the pull-rivet stroke in the traditional thread structure, but also adds new features and functions to the riveting tool chuck.

If the one-way safety valve mechanism of the present invention is changed to a two-way safety valve mechanism, bidirectional (positive pressure and negative pressure) threshold settings for the medium pressure in the valve cavity can be achieved. For example, a low pressure overload protection safety valve 95 is provided on the valve core. The working pressure of the medium in the valve cavity will be limited to the range of the positive pressure threshold and the negative pressure threshold; it can also be achieved by place a separate low pressure overload protection safety valve at other location or other components such as the side of the cylinder or the front end of the screw within the closed valve cavity; or directly replace the valve core with any suitable type of two-way safety valve, and adapt the two-way safety valve and the pre-loading spring associated with this change so as to limit the working pressure of the medium in the valve cavity to the range of the positive pressure threshold and negative pressure threshold, because the valve core of the safety valve mechanism is closed when the working pressure in the valve cavity is within the threshold range, so such cases are also included in the scope of protection of the present invention. In this case, the threshold range of the two-way safety valve may be unidirectionally adjustable or bidirectionally adjustable.

In the present invention, when the claws 5 are in the radially fully open state, the distance between the front end of the valve body 91 and the rear end of each of the claws 5 is smaller than the length of the riveting fastener tail rod 100 remaining in the cylindrical handle 1. That is, when the claws are completely loosened, the blind rivet tail rod waste can only be moved to contact with the valve core at most, and the front end of the tail rod waste material is still in the claw clamping region, so as to prevent the serious product failure problems of refilling the tail rod scrap which is not discharged but remained in the cavity, to new blind rivets. In order to solve the above problem of the discharging failure of the tail rod (see JP3993844), the tail through hole of the claw top column (see JP3993844, shown in FIG. 2) can be turned into a blind hole or a through hole with a diameter smaller than the diameter of the smallest tail rod of the blind rivet, thereby making the claw top column become a component functions with a tail rod stop function.

The invention adopts a cylindrical handle with a one-piece structure, and reduces the parts compared with the prior art (see JP399 3844 or US006018978). The rear end of the cylindrical handle 1 is provided with an annular groove 11, an elastic annular ring groove 12 is provided within the inner sleeve 11, the elastic ring 12 serves stopping slip effect and therefore improves the security when using. The locking ring increases the reliability of the fastening connection.

Figure 7:
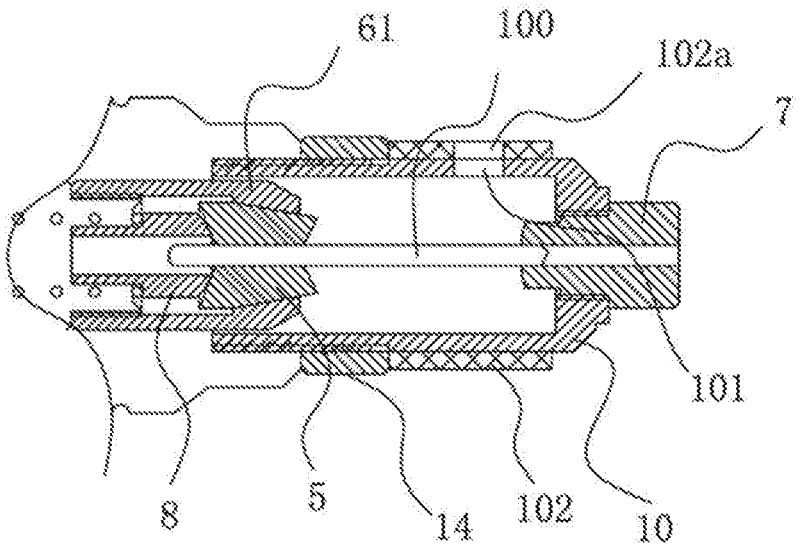
FIG. 7 is a partial structural view of the present invention.

The prior art (see JP3993844) has an opening on the front sleeve, which is convenient for observing the movement state and loss state of the component in the visible range inside the cavity, and the opening has the function of locking and loosening the front sleeve by inserting the crowbar into the opening. Since the opening does not have any blocking, foreign matter easily passes through the opening into the inner cavity of the front sleeve and the inner cavity of the cylindrical handle of the one-piece structure. Taking into account the actual working conditions of the riveting work, if there is foreign matter such as sand, metal shavings, dirt, etc., passing through the opening into the inner wall of the outer casing or all other parts or moving parts between them, the foreign objects can seriously affect the function, performance, longevity, and even other safety issues of the tool. As shown in FIG. 7, in the present invention, the front outer sleeve 10 is provided with at least one opening 101; the front outer sleeve 10 is provided with a transparent protection cover 102 capable of closing the opening 101. The transparent protection cover 102 is provided with at least one operation hole 102*a* and the at least one operation hole 102*a* can be opposed to the at least one opening 101 when the transparent protection cover 102 is rotated. The transparent protection cover 102 which is transparent or with high transparency is added on the basis of the opening, retain the observation hole function while adding knurling, hexagonal or other structures which can be clamped at proper positions of the front outer sleeve, so as to solve the problem of slack between the front outer sleeve 10 and the one-piece structure cylindrical handle. The opening is added to the cylindrical handle of the one-piece structure to observe the steering of the screw and the connection state with the chuck of the driving device, and the forward and backward directions of the claws are determined by the screw steering.

The above mainly introduces the riveting tool chuck, and obviously the riveting tool using the above riveting tool chuck comprises the driving device 20, the riveting tool chuck can be connected with the driving device 20, and the power output shaft of the driving device 20 is connected with the rotating part 2, and the driving device 20 is an electric driving device or a manual driving device.

Figure 6A:
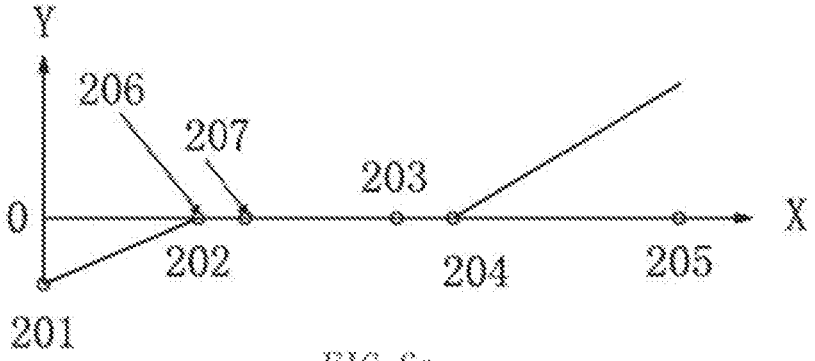
FIG. 6*a* is a comparative diagram of the screw pair pre-loading force and the screw pair conversion position during the pull-rivet stroke in US0060189787.
Figure 6B:
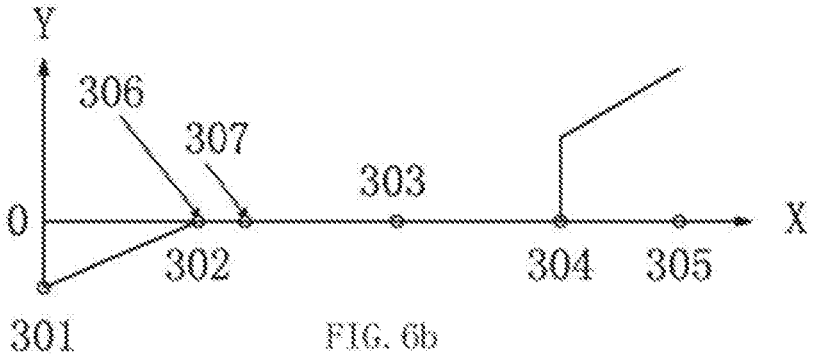
FIG. 6*b* is a comparative diagram of the screw pair pre-loading force and the screw pair conversion position during the pull-rivet stroke in JP3993844.
Figure 6C:
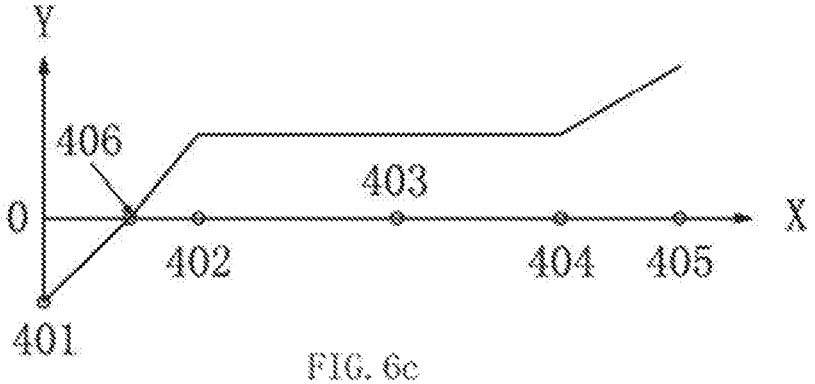
FIG. 6*c* is a comparative diagram of the screw pair pre-loading force and the screw pair conversion position during the pull-rivet stroke according to the present invention.

FIG. 6*a*, FIG. 6*b* and FIG. 6*c* are respectively comparative comparison diagrams of the scree pair preloading force and the screw pair conversion position in the pull-rivet stroke of the present invention, the patent JP3993844 and the patent US0060189787. The technical effect of the present invention which is different from the prior art can be more clearly found by comparing FIG. 6*a*, FIG. 6*b* and FIG. 6*c*. In the figure, the X axis represents the pull-rivet stroke and the Y axis represents the preloading force on the screw pair.

FIG. 6*a*: US0060189787, analysis of the screw pair pre-loading force and the screw pair conversion position in the pull-rivet stroke:

201—Patent US0060189787 the starting point of the early period stroke of the pull-rivet;

202—Patent US0060189787 the starting point of the middle period stroke of the pull-rivet;

203—Patent US0060189787 the position where the blind rivet core rod is pulled off;

204—Patent US0060189787 the starting point of the late period stroke of the pull-rivet;

205—Patent US0060189787 the end point of the complete pull-rivet stroke end point;

206—Patent US0060189787 the position where the screw pair conversion begins;

207—Patent US0060189787 the position where the screw pair conversion completes.

The distance between 206 and 207 is the idle return of the threaded transmission, the idle return stroke is caused by the thread gap, and the thread wear increases the gap between the threads; from starting point 201 of the early period stroke of the pull-rivet to the end point 205 there is pre-loading force on the screw pair, and the pre-loading force of the early period and the pre-loading force of the late period are opposite axially to each other, respectively solving the early and late re-entry problem of the threads; the position 206 where the screw pair conversion begins is also the starting point 202 of the middle period stroke of the pull-rivet, and idle return stroke need to be performed before completing the conversion to reach the position 207 where the screw pair conversion completes. In the middle period of the pull-rivet stroke, the spring is compressed and the pre-loading force begins to exist on the screw pair, so the screw pair conversion is passively completed under the constraint of the screw transmission displacement; when the core rod of the blind rivet is pulled off in position 205, the sharp change of the pull-rivet load will cause a load impact on the screw pair.

FIG. 6*b*: JP3993844, analysis of the screw pair pre-loading force and the screw pair conversion position in the pull-rivet stroke:

301—patent JP3993844 the starting point of the early period stroke of the pull-rivet;

302—Patent JP3993844 the starting point of the middle period stroke of the pull-rivet;

303—Patent JP3993844 the position where the blind rivet core rod is pulled off;

304—patent JP3993844 the starting point of the late period stroke of the pull-rivet;

305—Patent JP3993844 the end point of the complete pull-rivet stroke end point;

306—Purpose JP3993844 the position where the screw pair conversion begins;

307—Patent JP3993844 the position where the screw pair conversion completes.

The distance between 306 and 307 is the idle return of the threaded transmission, the idle return stroke is caused by the thread gap, and the thread wear increases the gap between the threads; from starting point 301 of the early period stroke of the pull-rivet to the end point 305 there is pre-loading force on the screw pair, and the pre-loading force of the early period and the pre-loading force of the late period are opposite axially to each other, respectively solving the early and late re-entry problem of the threads; the position 306 where the screw pair conversion begins is also the starting point 302 of the middle period stroke of the pull-rivet, and idle return stroke need to be performed before completing the conversion to reach the position 307 where the screw pair conversion completes. In the middle period of the pull-rivet stroke, the pre-loading force on the screw pair is zero, so the screw pair conversion is passively completed under the constraint of the screw transmission displacement; when the core rod of the blind rivet is pulled off in position 305, the drastic change of the pull-rivet load will cause a load impact on the screw pair.

FIG. 6*c* shows the analysis of the screw pair pre-loading force and the screw pair conversion position in the pull-rivet stroke of the present invention:

401—the starting point of the early period stroke of the pull-rivet in the present invention;

402—the starting point of the middle period stroke of the pull-rivet in the present invention;

403—the position the blind rivet core rod is pulled off in the present invention;

404—the starting point of the late period stroke of the pull-rivet in the present invention;

405—the end point of the complete pull-rivet stroke end point in the present invention;

406—the position where the screw pair conversion begins in the present invention.

The safety valve mechanism begins to actively engage the threaded transmission system at the starting point 401 of the early period stroke of the pull-rivet, and the screw pair conversion mode is automatically completed at the position 406 of the front and rear axial force balance, and the position 406 where the screw pair conversion begins is at the early period of the pull-rivet stroke. The conversion has been completed before the starting point 402 of the middle period stroke of the pull-rivet, so there is no problem of idle return stroke; from the starting point 401 of the pull-rivet early period stroke to the end point 405 of the complete pull-rivet stroke there is preloading force on the screw pair, and the pre-loading force of the early period and the pre-loading force of the late period are opposite axially to each other, respectively solving the early and late re-entry problem of the threads; in the entire pull-rivet stroke, the screw pair has a continuous pre-loading force, which can automatically compensate the thread wear, and helps to buffer the load impact during the pull-rivet process; during the middle period stroke of the pull-rivet, the diameter of the rivet tail rod directly affects the compression amount of the spring of the safety valve, which affects the maximum threshold pressure of the safety valve mechanism. The maximum preload on the screw pair is different when rivets have different specifications. The larger the diameter of the tail rod is, greater the pre-loading force existing on the screw pair is. Hence the pre-loading force on the screw pair has an adjustable characteristic; if the pressure of the safety valve mechanism reaches the maximum threshold level at or before the starting point 402 of the middle period stroke of the pull-rivet, then during the whole stroke of the middle period, the pre-loading force of the screw pair is the maximum axial force that the safety valve mechanism acts on the screw pair.

Embodiment 2

Figure 9:
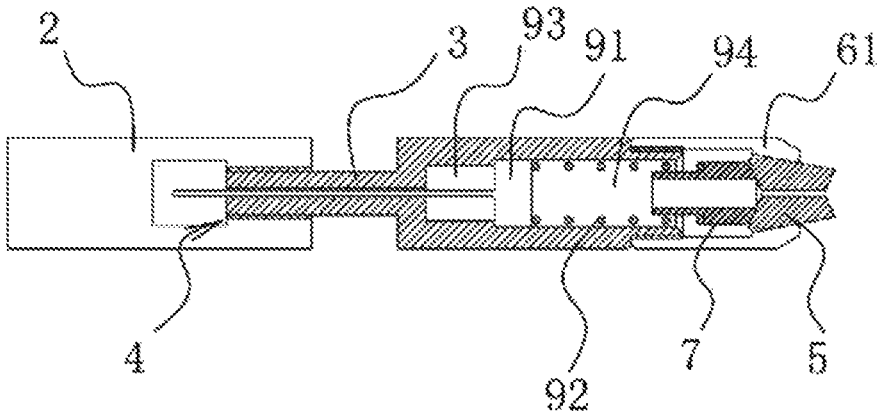
FIG. 9 is a partial schematic structural view of embodiment 2 of the present invention.

As shown in FIG. 9, in this embodiment, the rotating part 2 has a screw hole, the transmission part 3 has a threaded post, and the screw hole and the threaded post can be screwed; the safety valve mechanism 9 is provided with an axial through hole 94 arranged on the transmission part 3 and a valve core 91 disposed in the axial through hole 94 and capable of blocking the middle portion of the axial through hole 94, a spring 92 is disposed between the valve body 91 and the claw top column 8. One end of the spring 92 acts on the claw top column 8, and the other end acts on the valve core 91. A valve cavity 93 is formed among the rotating part 2, the transmission part 3 and the valve core 91 and can change its volume with the axial relative positions of the rotating part 2 and the transmission part 3, thereby changing the internal pressure thereof. The exchange of the screw and sleeve mechanism of the rotating part and the transmission part is realized. The rest of the structure of this embodiment is similar to that of the embodiment 1.

Embodiment 3

In the present embodiment, the cylindrical guiding nozzle 7 includes a cylindrical rear portion provided in the front outer sleeve 10 and allowing the front end of each claw 5 to lean against thereon, and a rotary table rotatably connected to the front end of the front outer sleeve 10. The cylindrical rear portion and the front outer sleeve 10 are connected in a detachable manner or form as integral. The rotating shaft of the rotary plate is eccentrically disposed with the central axis of the cylindrical rear portion, and the rotary plate is provided with a plurality of pull-rivet apertures with different sizes, the center of each pull-rivet aperture is located on the same circumference and the central axis of each pull-rivet aperture can respectively coincide with the central axis of the cylindrical rear portion when the rotary plate is rotated, and a positioning structure is disposed between the rotary plate and the front outer sleeve 10. The rest of the structure of this embodiment is similar to that of the embodiment 1.

The specific embodiments described herein are merely illustrative of the spirit of the invention. Those skilled in the art of the present invention can make various modifications or additions, or a similar alternative embodiment to the specific embodiments described, but without departing from the spirit of the present invention or the defined scope of the appended claims.

Although the terms cylindrical handle 1, annular groove 11, elastic ring 12, avoidance observation notch 13, locking ring 14, bearing 15, C-type retaining spring 16, E-type retaining spring 17, and anti-rotation limit pin 18, rotating part 2, transmission part 3, strip slot 31, threaded structure 4, claw 5, limiting structure 6, claw sleeve 61, central through hole 61*a*, cylindrical guiding nozzle 7, claw top column 8, safety valve mechanism 9, front outer sleeve 10, opening 101, transparent protection cover 102, operating hole 102*a*, valve core 91, spring 92, valve cavity 93, axial through hole 94, overload protection safety valve 95, riveting fastener tail rod 100, drive device 20, etc., are frequently used herein. These do not preclude possibility of using other terms. These terms are only used to describe and explain nature of invention more conveniently; it is to be construed that any additional limitation is inconsistent with spirit of invention.

The invention claimed is:

1. A riveting tool chuck, including a cylindrical handle, which is provided with a rotating part through the cylindrical handle, the rotating part is positioned axially and rotatably circumferentially connected to the cylindrical handle; and a transmission part that is circumferentially positioned and axially movably connected to the cylindrical handle, wherein the rotating part and the transmission part are connected by a threaded structure, and a plurality of claws-distributed in the circumferential direction and a limiting structure-capable of preventing the claws from being detached are arranged at the front end of the transmission part, wherein the front end of the cylindrical handle is provided with a cylindrical guiding nozzle making the front end of each claw against the rear end thereof, and between the front end of the transmission part and the rear end of each claw are provided with a claw top column, the claw top column can push the transmission part to move forward axially so that the claws are radially separated under the cooperation of the cylindrical guiding nozzle when the rotating part is reversed, and can drive the transmission part to move axially backwards so that the claws are radially gathered and continue to move axially backwards when the rotating part rotates forward, wherein: a safety valve mechanism enabling the threaded structure to have a screw pair pre-loading force is arranged between the claw top column and the transmission part, and the safety valve mechanism enables the screw pair conversion of the threaded structure to be performed before the axial reaction force between the front end of each claw and the rear end of the cylindrical guiding nozzle is reduced to zero during the forward rotation of the rotating part, thereby avoiding the idle return stroke of the thread structure.

2. The riveting tool chuck in accordance with claim 1, wherein: the rotating part is a screw, the transmission part is a cylinder, and the front end of the screw and the rear end of the cylinder can be connected by the threaded structure; the safety valve mechanism comprises a valve core, the valve core is arranged in the cylinder and acted as a block in the middle of the cylinder, and a spring arranged between the valve core and the claw top column, the spring acts on the claw top column on one end and acts on the valve core on the other end, a valve cavity is formed between the screw, the cylinder and the valve core, the volume of the valve cavity can change according to the axial relative position of the screw and the cylinder to change the pressure inside.

3. The riveting tool chuck in accordance with claim 1, wherein: the rotating part has a screw hole, the transmission part has a threaded post, and the screw hole and the threaded post can be screwed; the safety valve mechanism comprises an axial through hole disposed on the transmission part and a valve core disposed in the axial through hole and acted as a block in the middle of the axial through hole, wherein the valve core and the claw top column are provided with a spring, one end of the spring acts on the claw top column, and the other end acts on the valve core, and the rotating part, a valve cavity is formed between the screw, the cylinder and the valve core, the volume of the valve cavity can change according to the axial relative position of the screw and the cylinder to change the pressure inside.

4. The riveting tool chuck in accordance with claim 2, wherein: the safety valve mechanism is a one-way safety valve mechanism, and when the pressure in the valve cavity is greater than the spring pre-loading force, the valve core can be pushed open to relieve pressure.

5. The riveting tool chuck in accordance with claim 2, wherein: the safety valve mechanism is a two-way safety valve mechanism, and a low-pressure overload protection safety valve is provided on the safety valve mechanism, and the low-pressure overload protection safety valve is capable of increasing the pressure when the pressure in the valve cavity is less than a set value, and push the valve core open to relieve pressure when the pressure in the valve cavity is greater than the spring preloading force.

6. The riveting tool chuck in accordance with claim 1, wherein: the safety valve mechanism is a pressure adjustable safety valve mechanism or a fixed pressure safety valve mechanism, and if the safety valve mechanism is a fixed pressure safety valve mechanism, a pre-loading spring is arranged between the transmission part and the cylindrical handle; the valve cavity is provided with a medium, and the medium is a gas or a fluid.

7. The riveting tool chuck in accordance with claim 1, wherein: the cylindrical handle is provided with an annular groove in the rear end, and the annular groove is provided with an elastic sleeve ring, the rear end surface of the cylindrical handle is provided with at least one avoidance observation notch.

8. The riveting tool chuck in accordance with claim 1, wherein: the cylindrical guiding nozzle is provided on the front outer sleeve, the front outer sleeve is detachably secured in the front end of the cylindrical handle, and the front outer sleeve is detachably coupled to a locking ring that abuts against the front end surface of the cylindrical handle.

9. The riveting tool chuck in accordance with claim 8, wherein: the cylindrical guiding nozzle uses a detachable structure to connect to the front outer sleeve so that the front outer sleeve can be connected to any one of cylindrical guiding nozzles with different apertures.

10. The riveting tool chuck in accordance with claim 8, wherein: the guiding nozzle comprises a cylindrical rear portion provided in the front outer sleeve and allowing the front end of each claw to lean against thereon, and a rotary table rotatably connected to the front end of the front outer sleeve, the cylindrical rear portion and the front outer sleeve are connected in a detachable manner or form as integral, the rotating shaft of the rotary plate is eccentrically disposed with the central axis of the cylindrical rear portion, and the rotary plate is provided with a plurality of pull-rivet apertures with different sizes, the center of each pull-rivet aperture is located on the same circumference and the central axis of each pull-rivet aperture can respectively coincide with the central axis of the cylindrical rear portion when the rotary plate is rotated, and a positioning structure is disposed between the rotary plate and the front outer sleeve.

11. The riveting tool chuck in accordance with claim 8, wherein: the front outer sleeve is provided with at least one opening; the front outer sleeve is provided with a transparent protection cover closing the opening.

12. The riveting tool chuck in accordance with claim 11, wherein: the transparent protection cover is provided with at least one operation hole, and when the transparent protection cover rotates, at least one operation hole and at least one opening can be arranged opposite.

13. The riveting tool chuck in accordance with claim 1, wherein: the limiting structure comprises a claw sleeve, the claw sleeve is fixed to the front end of the transmission part, and the claw sleeve is provided with a central through hole and each claw passes through the central through hole, the inner wall of the central through hole is slidably engaged with the outer side surface of the claw through an inclined surface.

14. The riveting tool chuck in accordance with claim 13, wherein: the front end of the claw top column has a curved surface, the rear end of each claw has a tapered surface, and the curved surface of front end of the claw top column and the tapered surface of the rear end of each claw fit each other; the rear end of the cylindrical guiding nozzle has a tapered surface, and the front end of each claw has a tapered surface, and the tapered surface of the front end of each claw and the curved surface of the rear end of the cylindrical guiding nozzle fit each other.

15. The riveting tool chuck in accordance with claim 1, wherein: when each claw is radially fully opened, the distance between the front end of the valve core and the rear end of each claw is less than the length of the tail rod of the riveting fastener remaining in the cylindrical handle.

16. The riveting tool using the riveting tool chuck in accordance with claim 1, wherein: comprising a driving device, the riveting tool chuck being connectable to the driving device, and a power output shaft of the driving device is connected to the rotating part, the driving device is an electric drive or a manual drive.

* * * * *